US010054899B2

(12) United States Patent
Miyamoto

(10) Patent No.: US 10,054,899 B2
(45) Date of Patent: Aug. 21, 2018

(54) IMAGE FORMING APPARATUS INCLUDING COVER MEMBER RESTRICTING ATTACHING AND DETACHING OF IMAGING UNIT

(71) Applicant: KYOCERA Document Solutions Inc., Osaka (JP)

(72) Inventor: Teruyuki Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/582,822

(22) Filed: May 1, 2017

(65) Prior Publication Data

US 2017/0336753 A1 Nov. 23, 2017

(30) Foreign Application Priority Data

May 18, 2016 (JP) ..... 2016-099668

(51) Int. Cl.
*G03G 21/16* (2006.01)

(52) U.S. Cl.
CPC . *G03G 21/1633* (2013.01); *G03G 2221/1654* (2013.01)

(58) Field of Classification Search
CPC ..... G03G 21/1633; G03G 21/1676; G03G 21/1647; G03G 15/0886; G03G 2221/1654
See application file for complete search history.

(56) References Cited

U.S. PATENT DOCUMENTS 7,392,004 B2 * 6/2008 Sato ..... G03G 21/1633 219/216
8,995,030 B2 3/2015 Kakuta et al.
2010/0178075 A1 * 7/2010 Seorl ..... G03G 21/1842 399/114

FOREIGN PATENT DOCUMENTS

JP 2009-015126 A 1/2009
JP 2014-194485 A 10/2014

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

An image forming apparatus includes an imaging unit attachable/detachable at a predetermined position of an apparatus body. The imaging unit includes a locking member and a cover member. The locking member is configured so as to move between a lock position engaging with the apparatus body when the imaging unit is attached to the predetermined position and a lock release position releasing engaging with the apparatus body. The cover member is attached to/detached from the imaging unit in a first direction. The cover member has a connecting part making possible to be attached to the imaging unit in a second direction. When the cover member is attached to the imaging unit in the second direction, the connecting part moves the locking member from the lock position to the lock release position and the imaging unit becomes a state capable of being detached from the predetermined position.

6 Claims, 16 Drawing Sheets

IMAGE FORMING APPARATUS INCLUDING COVER MEMBER RESTRICTING ATTACHING AND DETACHING OF IMAGING UNIT

INCORPORATION BY REFERENCE

This application is based on and claims the benefit of priority from Japanese Patent application No. 2016-099668 filed on May 18, 2016, the entire contents of which are incorporated herein by reference.

BACKGROUND

The present disclosure relates to an image forming apparatus including an attachable/detachable imaging unit.

In an image forming apparatus, such as a printer or a copying machine, an imaging unit may be attachably/detachably provided in an apparatus body and a drive source of the imaging unit may be provided in the apparatus body. In the imaging unit and the drive source, a lever member operated for connecting them and connectors connected to each other are provided. Such lever member and connector are operated by a serviceman when required. Therefore, in order to prevent a general user from operating the lever member and the connector in error, the lever member and the connector may be protected by a cover member attachably/detachably provided.

However, there is a problem that such a cover member tends to be forgotten about attaching or to be lost after the cover member is detached once. If the cover member is not attached, the lever member and the connector remain exposed and it is feared that they are erroneously operated.

SUMMARY

In accordance with the present disclosure, an image forming apparatus includes an imaging unit being attachable/detachable at a predetermined position of an apparatus body. The imaging unit includes a locking member and a cover member. The locking member is configured so as to move between a lock position where it is engaged with the apparatus body when the imaging unit is attached to the predetermined position and a lock release position where engaging with the apparatus body is released. The cover member is attached to/detached from the imaging unit in a first direction. The cover member has a connecting part making possible to be attached to the imaging unit in a second direction different from the first direction. When the cover member is attached to the imaging unit in the second direction, the connecting part moves the locking member from the lock position to the lock release position and the imaging unit becomes a state capable of being detached from the predetermined position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus according to an embodiment of the present disclosure will be described.

Figure 1:
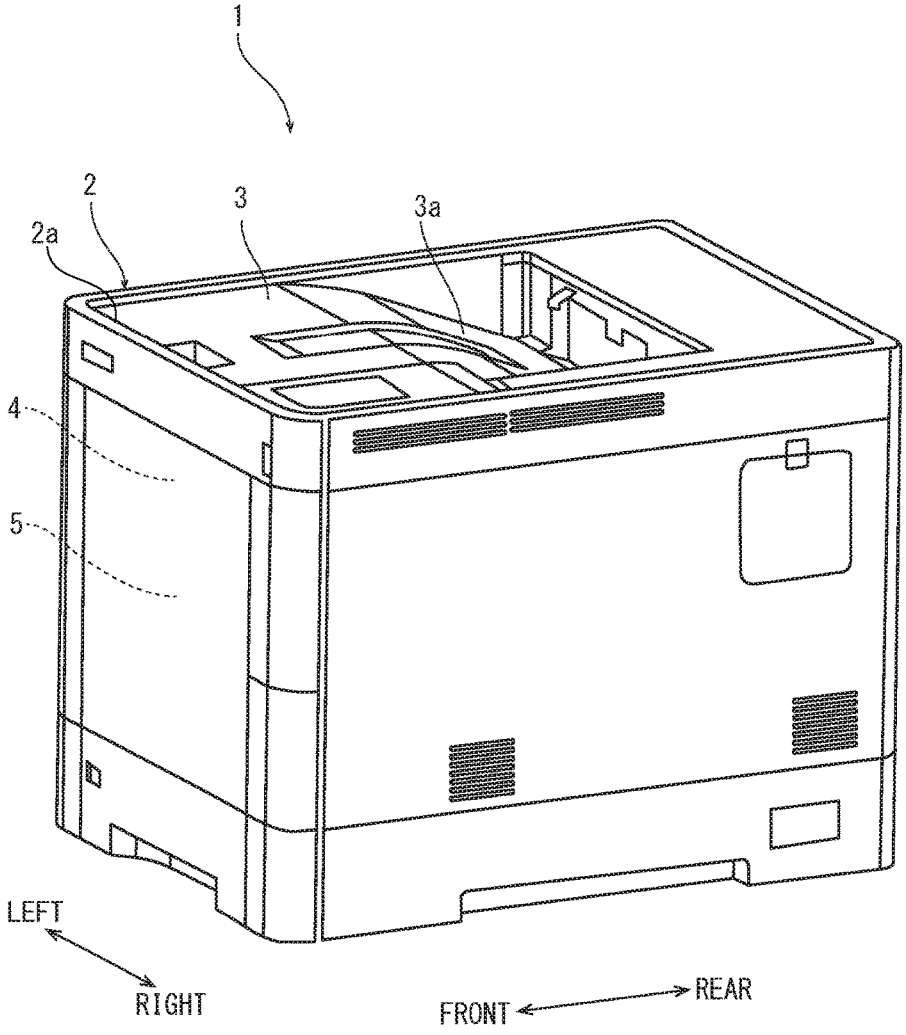
FIG. 1 is a perspective view showing a color printer according to an embodiment of the present disclosure.
Figures 1, 2:
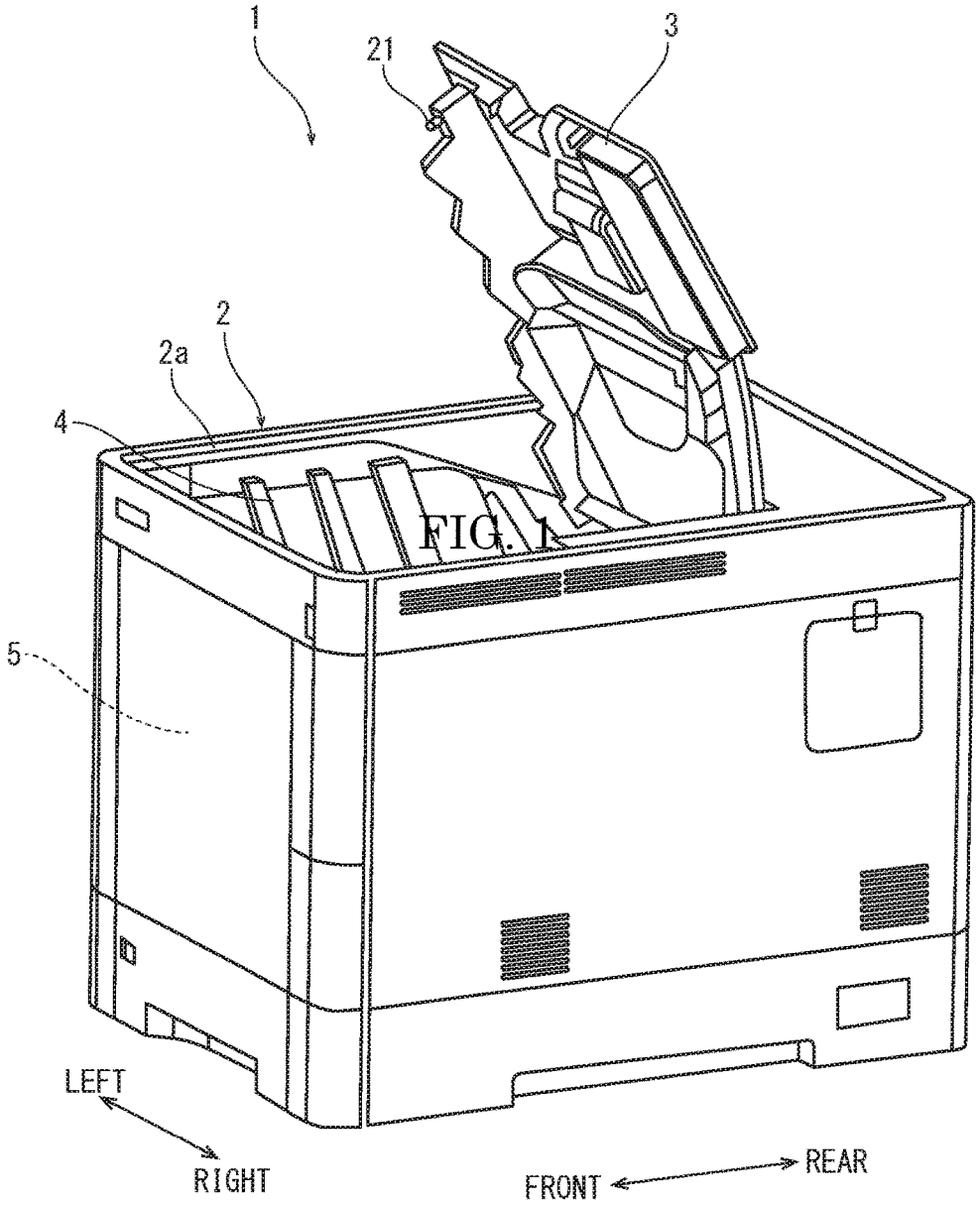
FIG. 2 is a perspective view showing the color printer in a state that a top face cover is turned according to the embodiment of the present disclosure.
Figure 3:
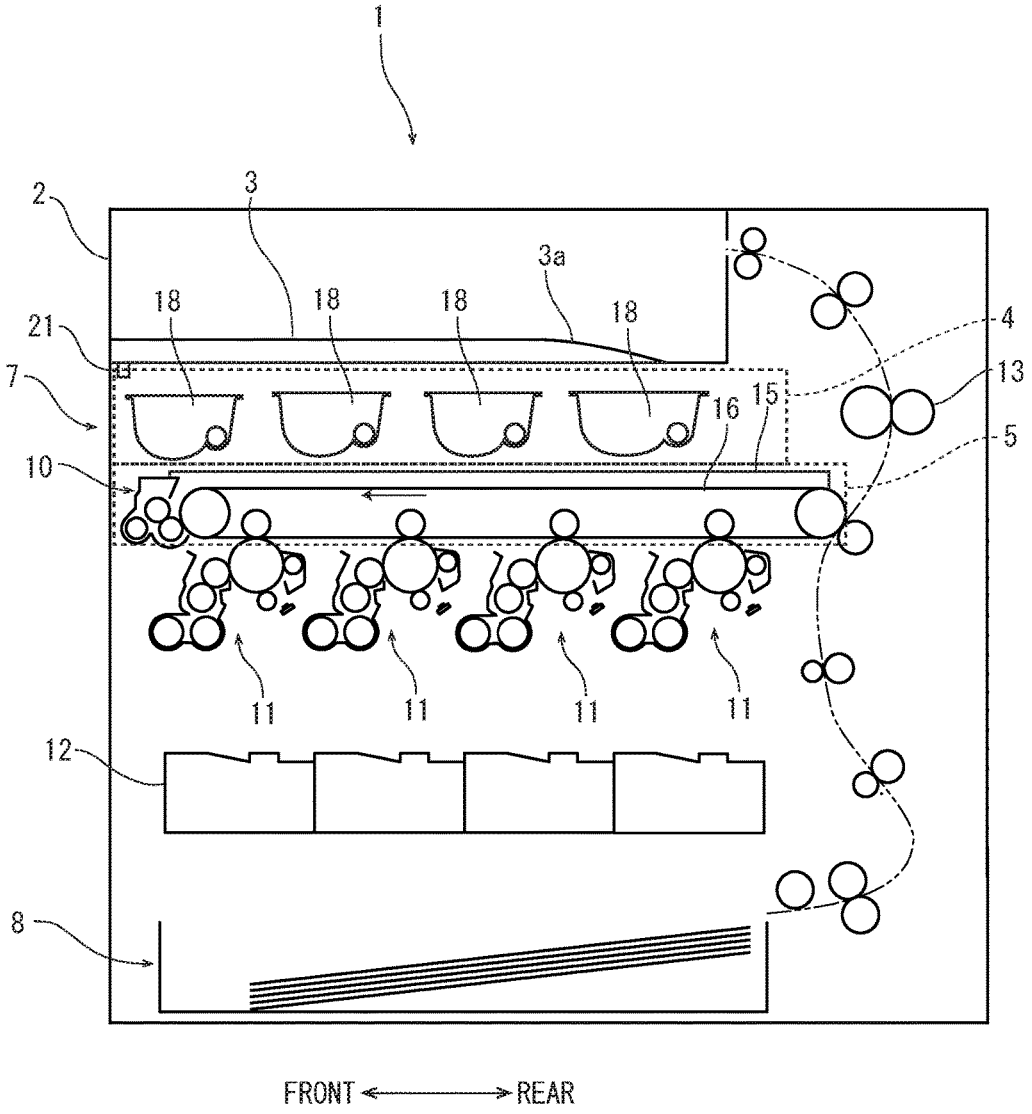
FIG. 3 is a front sectional view showing an internal structure of the color printer according to the embodiment of the present disclosure.

Firstly, the entire structure of a color printer 1 as the image forming apparatus according to the embodiment will be described with reference to FIGS. 1-3. FIG. 1 is a perspective view showing the color printer 1, FIG. 2 is a perspective view showing the color printer 1 in a state that a top face cover 3 is turned and a top face opening 2*a* is opened, and FIG. 3 is a sectional view schematically showing an internal structure of the color printer 1. Hereinafter, it will be described so that forward and backward directions of the color printer 1 are forward and backward directions shown in FIG. 1 and left and right directions are defined on the basis of a direction viewed the color printer 1 from the front side.

As shown in FIGS. 1 and 2, in an apparatus body 2 of the color printer 1, the opening 2*a* is formed in its top face. Moreover, in the apparatus body 2, the top face cover 3 as an opening/closing member opening and closing the opening 2*a* is provided so as to turn around its rear end. Below the opening 2*a*, a container storing part 4 is arranged and, below the container storing part 4, a unit storing part 5 is arranged.

As shown in FIG. 3, in the apparatus body 2, an image forming part 7 forming an image on a sheet and a sheet feeding cartridge 8 storing the sheet subjected to image forming are arranged. The image forming part 7 includes an intermediate transferring unit 10 as an imaging unit carrying out image forming, four image forming units 11 corresponding to four colors (yellow, magenta, cyan, black), an exposing device 12 and a fixing device 13. The intermediate transferring unit 10 includes an intermediate transferring belt 16 supported by a housing 15 so as to circulatively run, and is arranged so as to be attached to/detached from (a predetermined position of) the unit storing part 5. The four image forming units 11 are arranged in parallel in the forward and backward directions below the unit storing part 5. The respective image forming units 11 form and overlap toner images based on image data exposed by the exposing device 12 onto a surface of the intermediate transferring belt 16, and thereby, form a full-color toner image on the surface of the intermediate transferring belt 16. The fixing device 13 is arranged above a rear part of the unit storing part 5 to fix the full-color toner image transferred on the sheet to the sheet. In the container storing part 4, toner containers 18 containing toners of the respective colors are attached and detached.

As shown in FIG. 2, by turning the top face cover 3 backwardly, the top face opening 2*a* of the apparatus body 2 is opened and the toner containers 18 become attachable/detachable states with respect to the container storing part 4. Moreover, when all of the toner containers 18 are detached, the unit storing part 5 is opened through the container storing part 4 and the intermediate transferring unit 10 becomes an attachable/detachable state with respect to (a predetermined position of) the unit storing part 5. The intermediate transferring unit 10 is extracted diagonal forwardly from the top face opening 2*a*. Further, at a front right corner of a lower face of the top face cover 3, an actuator pin 21 protruded downwardly is erected.

In the color printer 1 having such a configuration, after the full-color toner image is formed on the sheet fed from the sheet feeding cartridge 8 in the image forming part 7, the sheet is ejected to an ejected sheet tray 3*a* provided in the top face cover 3.

Figure 4:
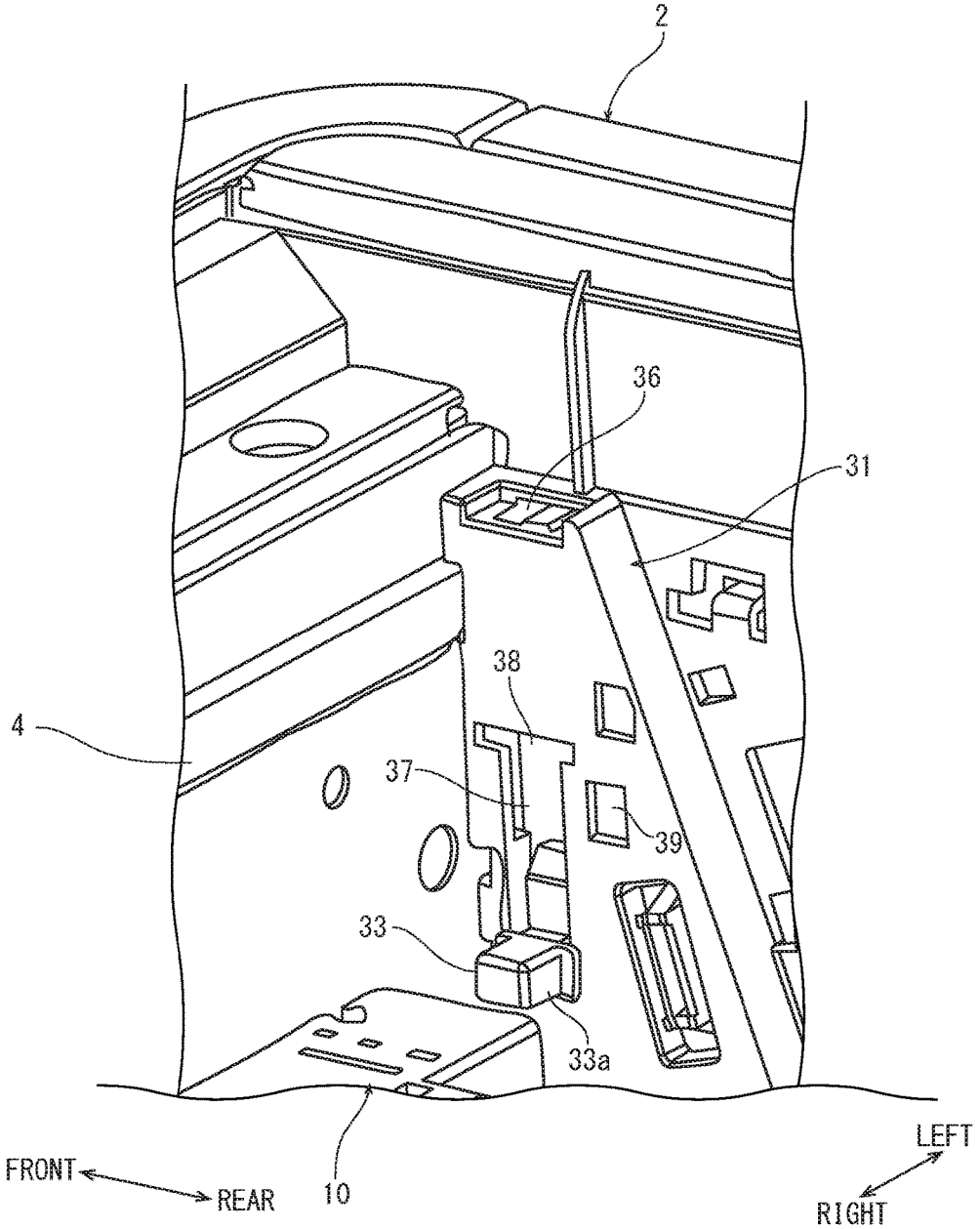
FIG. 4 is a perspective view showing an operation member storing part in the color printer according to the embodiment of the present disclosure.

Next, the container storing part 4 will be described with reference to FIGS. 4 and 5. FIG. 4 is a perspective view showing a front left corner of the container storing part 4 and FIG. 5 is a perspective view showing a hollow part of an operation member storing part 31 viewed from the left side.

As shown in FIG. 4, at the front left corner of the container storing part 4, the hollow operation member storing part 31 is formed. In the operation member storing part 31, as shown in FIG. 5, a drive lever 33, an opening/closing switch 34 (a switch member) and a pressing member 35 are stored. In an upper wall of the operation member storing part 31, a rectangular opening 36 is formed. This opening 36 can receive, when the top face opening 2*a* of the apparatus body 2 is closed by the top face cover 3, insertion of the actuator pin 21 (refer to FIG. 2) erected on the top face cover 3.

As shown in FIG. 4, in a right wall of the operation member storing part 31, a vertical elongated rectangular guide hole 37 is formed below the opening 36 formed in its top wall. In an upper end of the guide wall 37, a horizontal elongated rectangular first opening 38 is formed. Further, at a backward side and a diagonal lower side of the first opening 38, a rectangular second opening 39 is formed.

Figure 5:
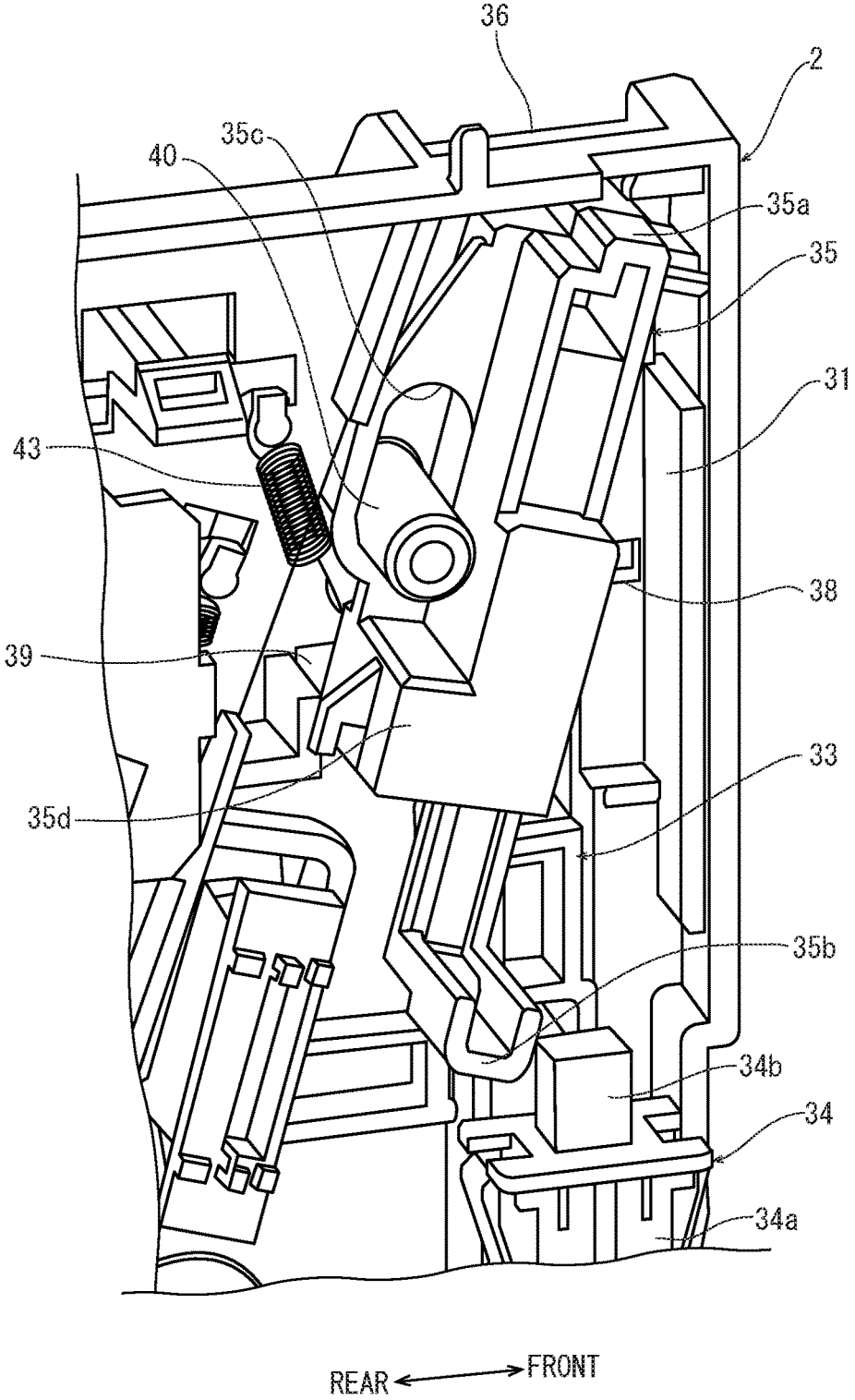
FIG. 5 is a perspective view showing the inside of the operation member storing part in the color printer according to the embodiment of the present disclosure.

Further, as shown in FIG. 5, in an inner face of the right wall, a supporting shaft 40 protruded to the inner side (the left side) is erected. The supporting shaft 40 is arranged at a forward side and a diagonal upper side of the second opening 39.

The drive lever 33 is a member connecting and disconnecting connection parts of the four image forming units 11 and a connection part of a drive source (not shown) provided in the apparatus body 2. As shown in FIG. 4, a head part 33*a* of the drive lever 33 is engaged with the guide hole 37 formed in the right wall of the operation member storing part 31, and is supported so as to slide in upward and downward directions along the guide hole 37. By pulling up the drive lever 33, the connection parts of the four image forming units 11 and the connection part of the drive source are connected and, by pulling down the drive lever 33, they are disconnected.

The opening/closing switch 34 is a push type switch detecting that the top face opening 2*a* of the apparatus body 2 is closed by the top face cover 3, and detects a closing condition and an opening condition of the top face cover 3 by pressing and releasing this pressing. As shown in FIG. 5, the opening/closing switch 34 includes a main body 34*a* and a switch part 34*b* pushed into the main body 34*a*, and is arranged below the opening 36 formed in the upper wall of the operation member storing part 31 in a posture that the switch part 34*b* is directed upwardly.

The pressing member 35 is a member interposed between the opening 36 and the opening/closing switch 34 to push the switch part 34*b* of the opening/closing switch 34. The pressing member 35 is formed in a roughly rectangular parallelepiped shape elongated vertically, in its upper end face, a pressed part 35*a* is formed and, in its lower end face, a pressing part 35*b* is formed. Between the pressed part 35*a* and the pressing part 35*b*, a long hole 35*c* is formed along a longitudinal direction of the pressing member 35. Below the long hole 35*c*, a rectangular parallelepiped protrusion part 35*d* protruded backwardly is formed. In a right face of the protrusion part 35*d*, a guide face inclined backwardly is formed.

With the long hole 35*c* of the pressing member 35, the supporting shaft 40 protruded from the right wall of the operation member storing part 31 to the hollow part is engaged. Thereby, the pressing member 35 is supported so as to turn around the supporting shaft 40. Moreover, between the protrusion part 35*d* of the pressing member 35 and the operation member storing part 31, a spring 43 is interposed. The spring 43 biases the pressing member 35 in a clockwise direction around the supporting shaft 40 in FIG. 5 and the upward direction. By such a biasing, the pressing member 35 takes, as shown in FIG. 5, an inclined posture that the pressed part 35*a* is separated forwardly from the opening 36 and the pressing part 35*b* is separated backwardly from the switch part 34*b* of the opening/closing switch 34. That is, the pressing member 35 takes a posture being impossible to press the switch part 34*b* of the opening/closing switch 34. On the other hand, if the pressing member 35 is turned against a biasing force of the spring 43 so as to take a vertical posture, the pressed part 35*a* is positioned just below the opening 36 and the pressing part 35*b* is positioned just above the switch part 34*b* to take a posture being possible to press the switch part 34*b* of the opening/closing switch 34.

Figure 6:
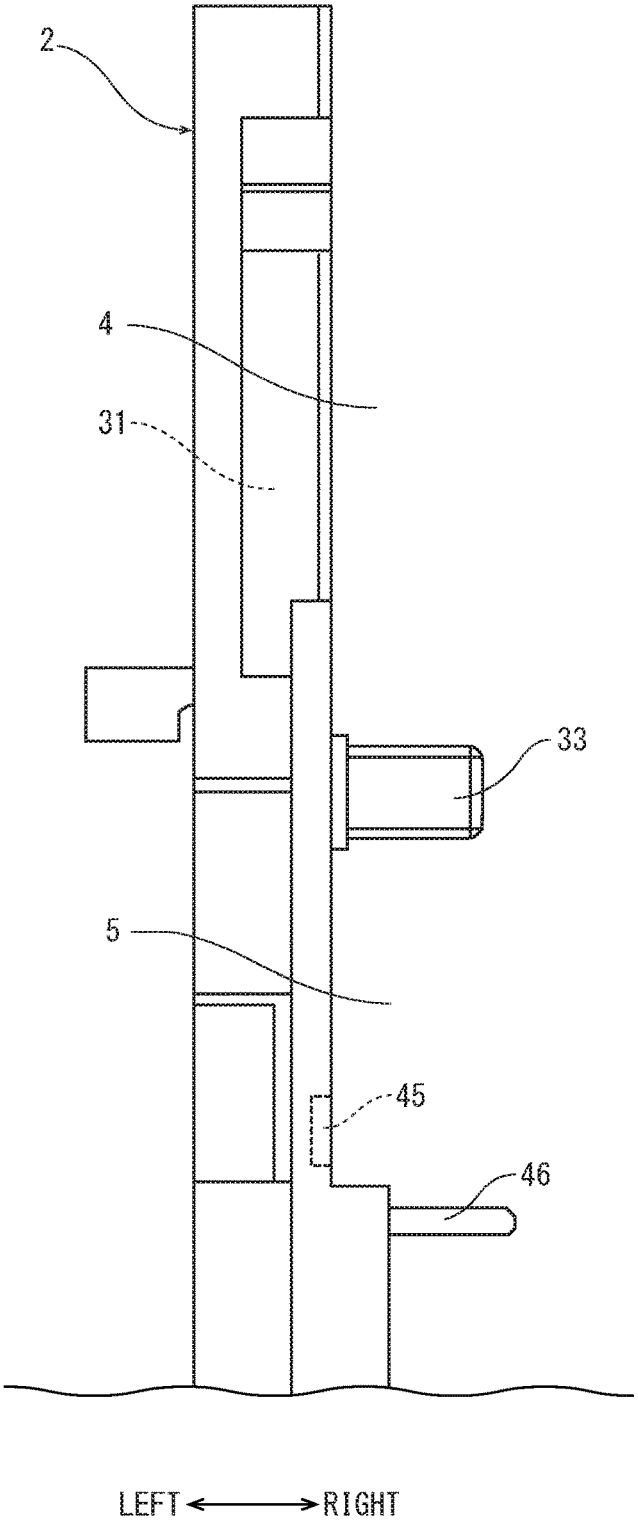
FIG. 6 is a front view showing a left end of a unit storing part in the color printer according to the embodiment of the present disclosure.

Next, the unit storing part 5 will be described with reference to FIG. 6. FIG. 6 is a side view showing a front end of a left face of the unit storing part 5. In the front end of the left face of the unit storing part 5, a horizontal elongated rectangular engaged recess part 45 is formed. Below the engaged recess part 45, a supporting piece 46 extended to the right side is formed.

Figure 7:
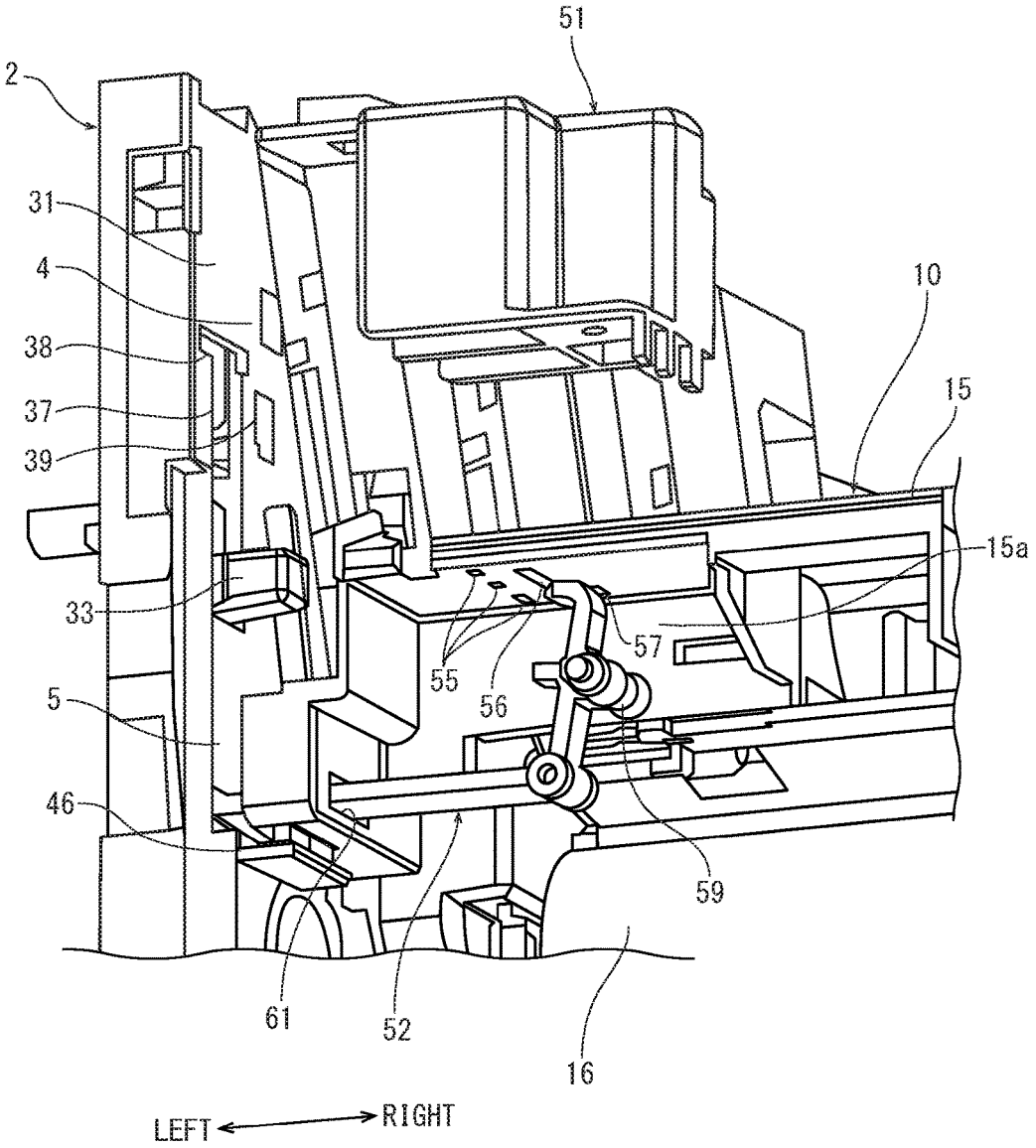
FIG. 7 is a perspective view showing a left end of an intermediate transferring unit in the color printer according to the embodiment of the present disclosure.
Figure 8A:
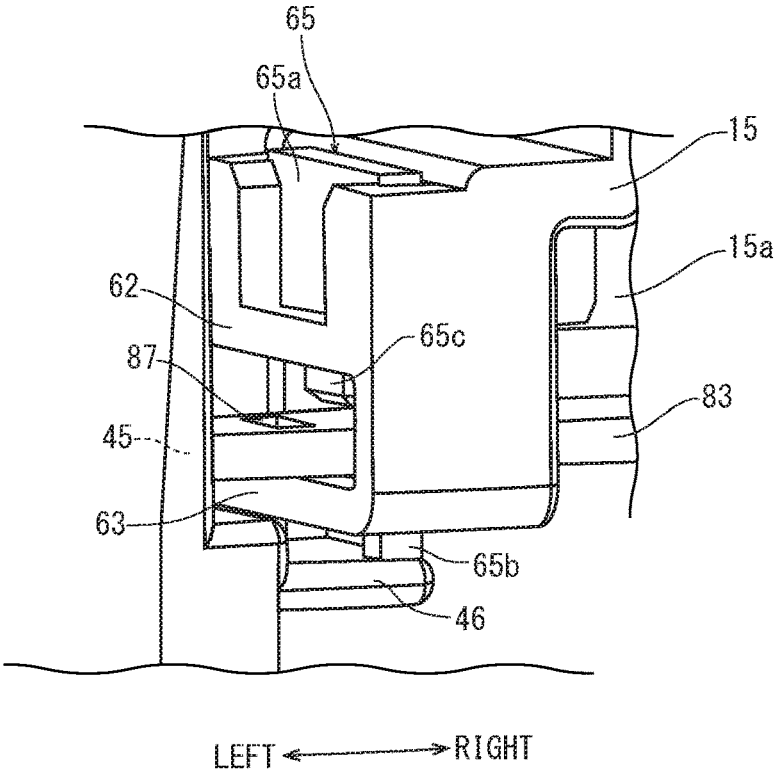
FIG. 8A is a perspective view showing a locking member and an engaged recess part engaged with each other in the left end of the intermediate transferring unit in the color printer according to the embodiment of the present disclosure and FIG. 8B is a front view showing a locking piece in the left end of the intermediate transferring unit in the color printer according to the embodiment of the present disclosure.
Figure 8B:
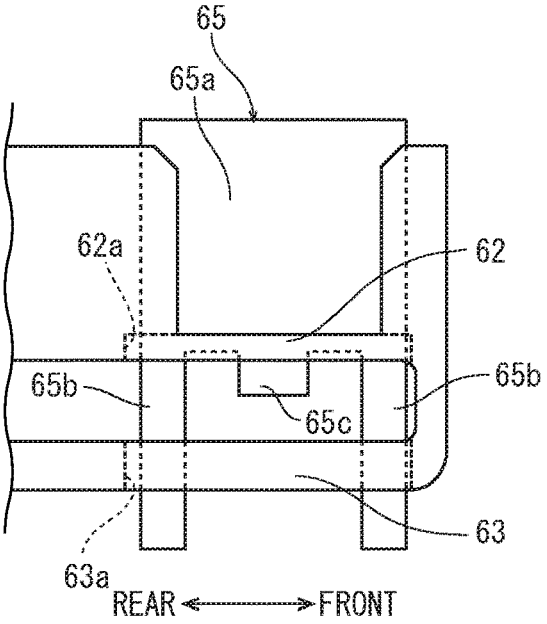

Next, the intermediate transferring unit 10 will be described with reference to FIGS. 7, 8A and 8B. FIG. 7 is a perspective view showing the inside of a storing recess part 15*a* of the intermediate transferring unit 10, FIG. 8A is a perspective view showing a left wall of the storing recess part 15*a* and FIG. 8B is a front view showing a locking piece 65.

As shown in FIG. 7, in the housing 15 of the intermediate transferring unit 10, the storing recess part 15*a* recessed upwardly as viewed from a lower side is formed at its front end. Onto an upper face of the storing recess part 15*a*, a cover member 51 is attachably/detachably provided and, inside the storing recess part 15*a*, a locking member 52 is provided.

In an upper wall of the storing recess part 15*a*, three attaching holes 55 are opened in parallel in the forward and backward directions. Further, at the right side of the attaching holes 55, a first insertion opening 56 in a rectangular shape elongated in the forward and backward directions is opened. At a rear right side of the first insertion opening 56, a rectangular second insertion opening 57 is opened.

On an inner face of a rear wall of the storing recess part 15*a*, a supporting shaft 59 protruded inwardly (forwardly) from the right side of the first insertion opening 56 is erected.

In the left wall of the storing recess part 15*a*, a horizontal elongated rectangular opening 61 is formed. Moreover, outside (at the left side of) the opening 61, as shown in FIG. 8A, an upper wall part 62 and a lower wall part 63 are horizontally formed at a predetermined interval in the upward and downward directions. In the upper wall part 62 and the lower wall part 63, as shown in FIG. 8B, an upper opening 62*a* and a lower opening 63*a* horizontally elongated in the forward and backward directions are respectively formed.

In the upper opening 62*a* and the lower opening 63*a*, the locking piece 65 is supported so as to traverse a gap between them to slide in the upward and downward directions. The locking piece 65 has, as shown in FIG. 8B, a main body part 65*a* in a rectangular plate shape and a pair of leg parts 65*b* extended downwardly from both ends of a lower end face of the main body part 65*a*. Further, between the pair of leg parts 65*b*, a protrusion piece 65*c* as a concave-convex part (a second concave-convex part) engaged with the locking member 52 is formed. A length of the protrusion piece 65*c* is shorter than the pair of leg parts 65*b*. When the locking piece 65 is slid upwardly, among the pair of leg parts 65*b*, the protrusion piece 65*c* and the lower wall part 63, a gap having a predetermined height is formed.

Figure 9A:
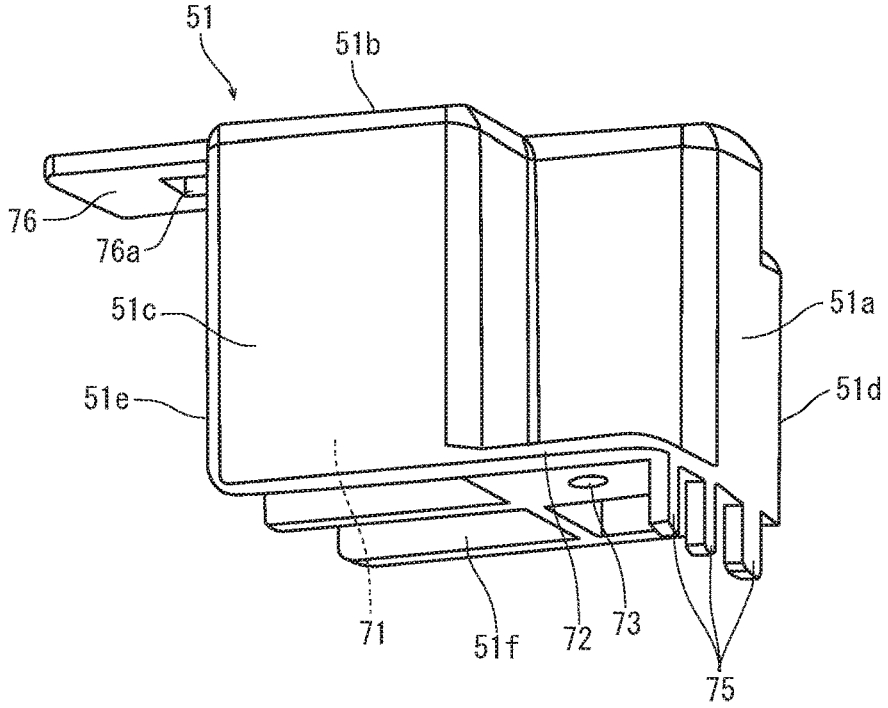
FIG. 9A is a perspective view showing a cover member supported in a state directed in a first direction in the color printer according to the embodiment of the present disclosure and FIG. 9B is a perspective view showing the cover member supported in a state directed in a second direction in the color printer according to the embodiment of the present disclosure.
Figure 9B:
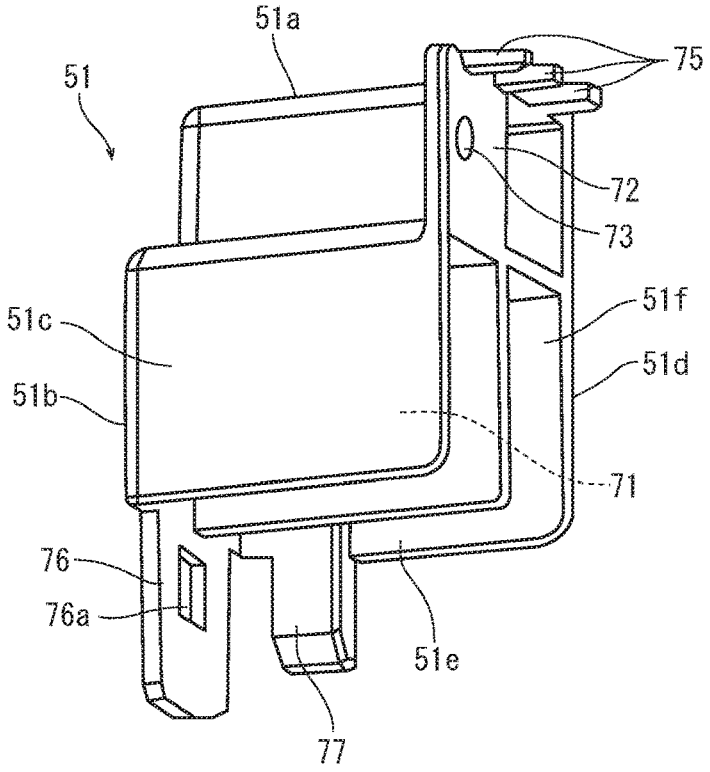

Next, the cover member 51 will be described with reference to FIGS. 9A and 9B. FIG. 9A is a perspective view showing the cover member 51 supported in a state directed in a first direction and FIG. 9B is a perspective view showing the cover member 51 supported in a state directed in a second direction.

The cover member 51 is a member protecting the head part 33*a* (refer to FIG. 4) of the drive lever 33 stored in the operation member storing part 31. It is feared that, when the drive lever 33 is carelessly operated, connection parts of the image forming units 11 and the drive source is damaged or the like. Therefore, in a state that the toner container 18 is detached, the drive lever 33 is protected by the cover member 51 without being exposed.

The cover member 51 is formed in a roughly rectangular parallelepiped shape to have a hollow part 71 surrounded by a first face 51*a*, a second face 51*b* orthogonally adjoining the first face 51*a*, a third face 51*c* and a fourth face 51*d* being respectively orthogonal to the first face 51*a* and the second face 51*b* and facing to each other. A fifth face 51*e* facing to the first face 51*a* and a sixth face 51*f* facing to the second face 51*b* are opened. A corner part between the first face 51*a* and the third face 51*c* is cut out in a rectangular parallelepiped shape. By such a cutout, the second face 51*b* is formed in an L-shape in a plan view. Moreover, in the sixth face 51*f*, an attachment part 72 is formed at a part corresponding to the cutout. In the attachment part 72, a through hole 73 is opened.

In the first face 51*a*, three attachment pieces 75 protruded from an edge at a side of the sixth face 51*f* are formed at predetermined intervals along the edge. In the second face 51*b*, a connecting piece 76 (a connecting part) protruded from an edge at a side of the fifth face 51*e* is formed. At the center of the connecting piece 76, a rectangular opening 76*a* as a concave-convex part (a first concave-convex part) engaging the cover member 51 with the locking member 52 is opened. Further, at a corner between the second face 51*b* and the fourth face 51*d*, a pressing piece 77 protruded in the same direction as the connecting piece 76 is formed. A distal end of the pressing piece 77 is formed in a curved shape (a tapered shape facing to the guide face of the protrusion part 35*d*). Thus, three attachment pieces 75, and the connecting piece 76 and the pressing piece 77 are formed so as to be orthogonal to each other.

Figure 10:
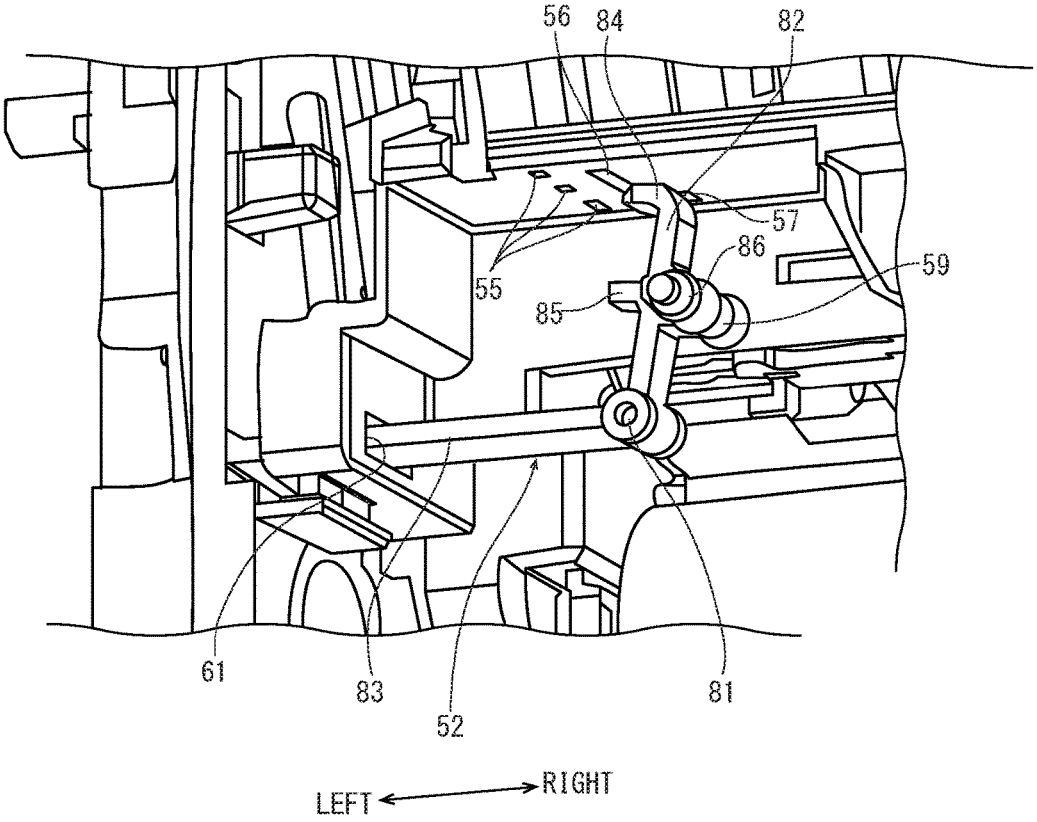
FIG. 10 is a perspective view showing the locking member in the color printer according to the embodiment of the present disclosure.

Next, the locking member 52 will be described with reference to FIGS. 8A and 10. FIG. 10 is a perspective view showing the locking member 52.

As shown in FIG. 10, the locking member 52 is a member engaged with the engaged recess part 45 (refer to FIG. 6) formed in the unit storing part 5 to lock the intermediate transferring unit 10 unmovably in the unit storing part 5. The locking member 52 is formed in an L-shape to have an elongated short arm 82 and an elongated long arm 83 connected so as to mutually turn around a rotation shaft 81.

In a distal end of the short arm 82, an engaging piece 84 as the concave-convex part (the first concave-convex part) engaging the cover member 51 with the locking member 52 is formed and curved to protrude to the left side. Further, on a face at the left side of the short arm 82, a pressed piece 85 protruded to the left side is formed near the center in its longitudinal direction. A protruded length of the pressed piece 85 from the face at the left side of the short arm 82 is longer than a protruded length of the engaging piece 84. In addition, on a face at the right side of the short arm 82, a cylindrical axial supporting part 86 in parallel to an axial direction of the rotation shaft 81 is formed near the center in its longitudinal direction. Moreover, as shown in FIG. 8A, in a distal end of the long arm 83, an opening 87 as the concave-convex part (the second concave-convex part) engaged with the locking piece 65 is opened.

The axial supporting part 86 of the locking member 52 is axially supported by the supporting shaft 59 formed in the storing recess part 15*a* of the housing 15 and the short arm 82 is biased by a torsion coil spring (not shown) so as to turn in the clockwise direction in FIG. 10. Thereby, the short arm 82 is turned to an inclined posture that the engaging piece 84 is separated from the first insertion opening 56 to the right side and the pressed piece 85 is located just below the first insertion opening 56.

The distal end of the long arm 83 is passed, as shown in FIG. 8A, through the opening formed in the left wall of the storing recess part 15*a* and a gap between the upper wall part 62 and the lower wall part 63, and is inserted into the engaged recess part 45 formed in the left face of the unit storing part 5. That is, when the locking member 52 is turned to a lock position where it is engaged with the unit storing part 5, the intermediate transferring unit 10 is unmovably locked in the unit storing part 5. The pair of leg parts 65*b* of the locking piece 65 are run on the supporting piece 46 formed below the engaged recess part 45 at both sides of the long arm 83 of the locking member 52. Moreover, the opening 87 formed in the distal end of the long arm 83 is separated from the protrusion piece 65*c* of the locking piece 65 to the left side.

On the other hand, when the short arm 82 is turned in a counter clockwise direction in FIG. 10 against biasing force of the torsion coil spring until it becomes a roughly vertical posture, the engaging piece 84 reaches just below the first insertion opening 56. Moreover, when the long arm 83 is slid to the right side, its distal end is separated from the engaged recess part 45 of the unit storing part 5. That is, the locking member 52 is turned to a lock release position where engaging with the unit storing part 5 is released. Thus, when the locking member 52 is turned to the lock release position, the opening 87 formed in the distal end of the long arm 83 is moved below the protrusion piece 65*c*.

Figure 11:
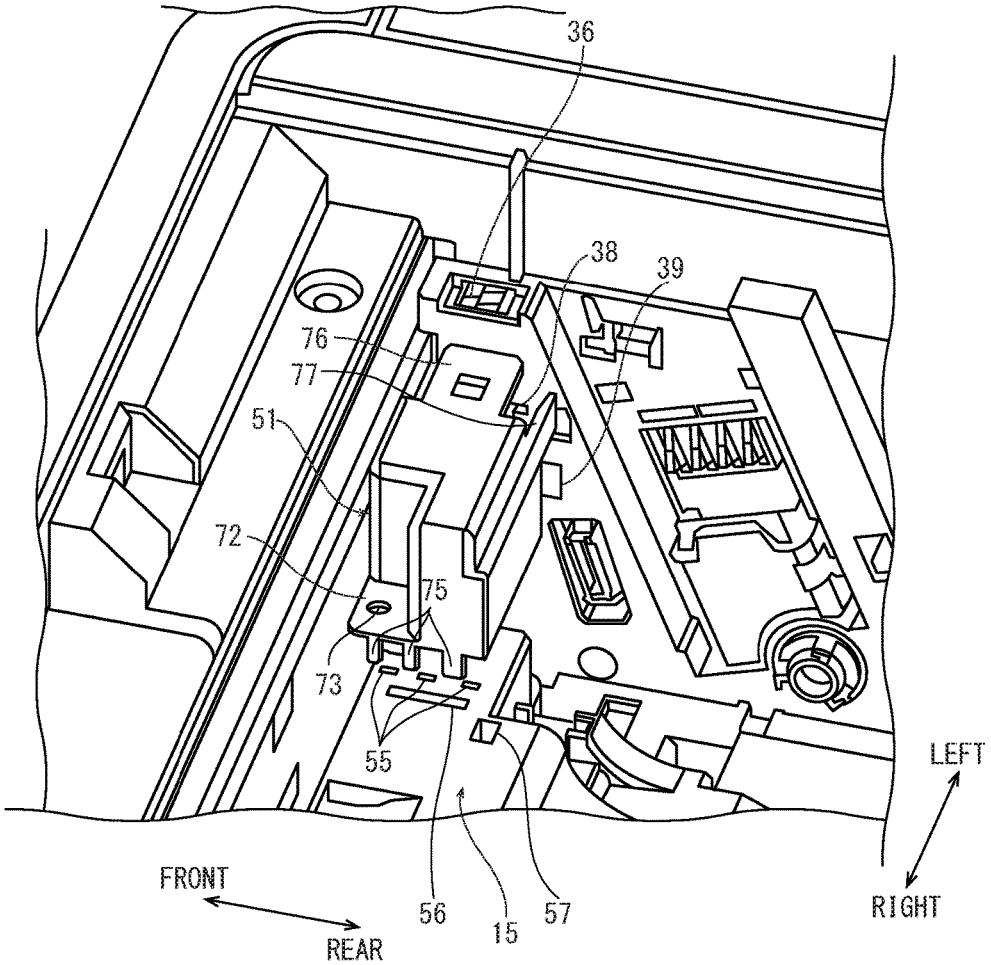
FIG. 11 is a perspective view showing the cover member attached to the intermediate transferring unit in the state directed in the first direction in the color printer according to the embodiment of the present disclosure.
Figure 12:
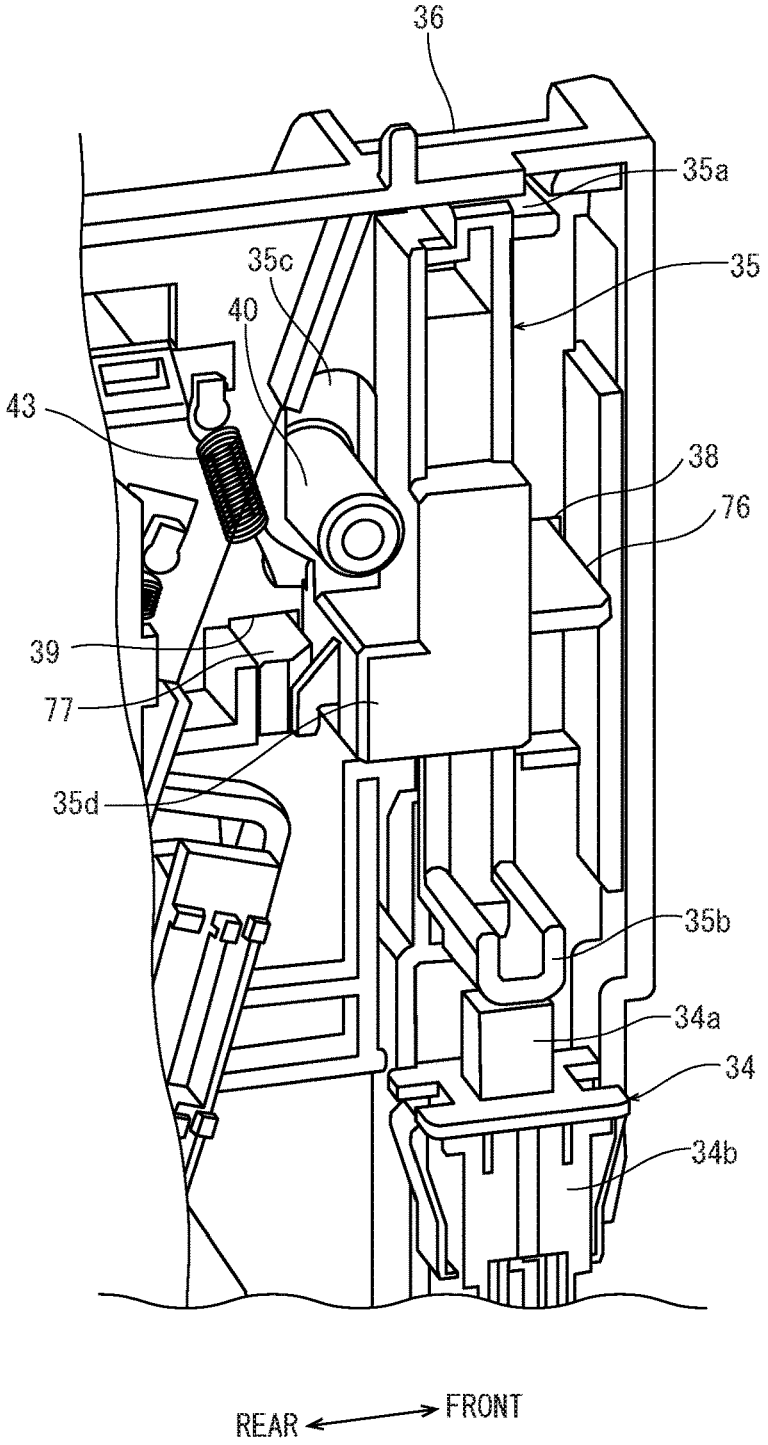
FIG. 12 is a perspective view showing a pressing member when attaching the cover member in the color printer according to the embodiment of the present disclosure.
Figure 13:
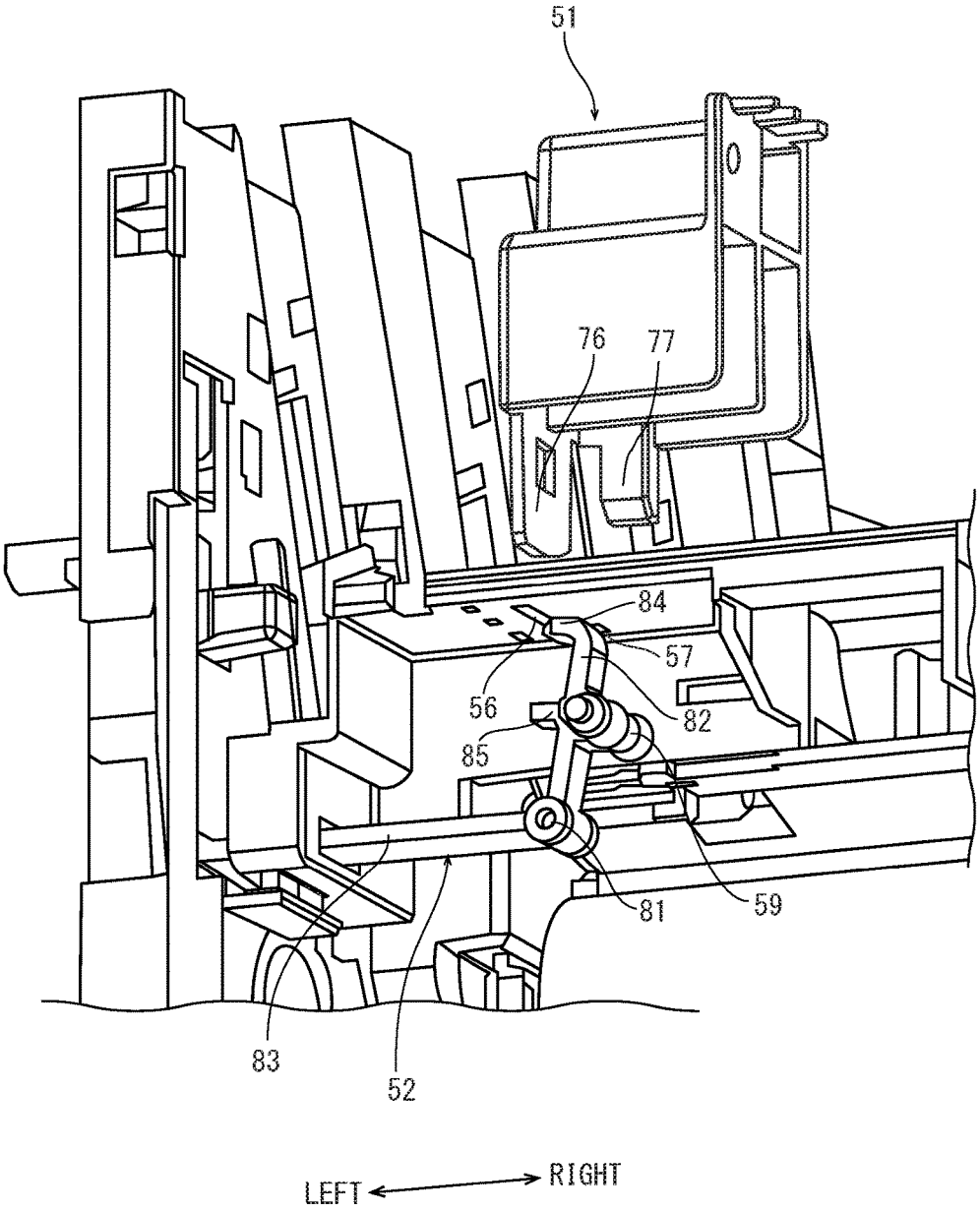
FIG. 13 is a perspective view showing the cover member attached to the intermediate transferring unit in the state directed in the second direction in the color printer according to the embodiment of the present disclosure.
Figure 14A:
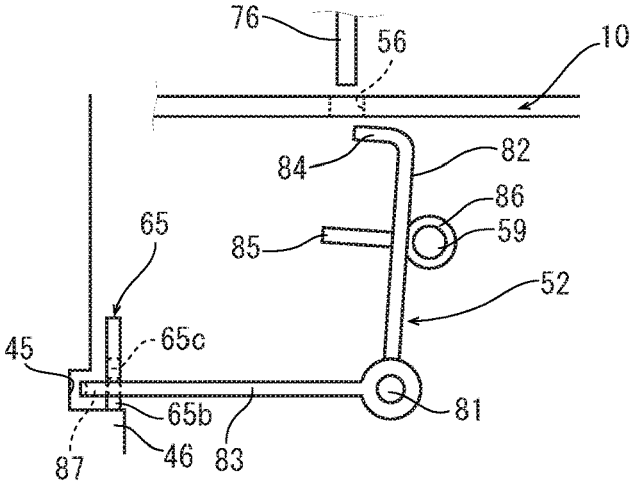
FIGS. 14A, 14B and 14C are schematic front view used for explaining locking operation of the cover member by the locking member in the color printer according to the embodiment of the present disclosure.
Figure 14B:
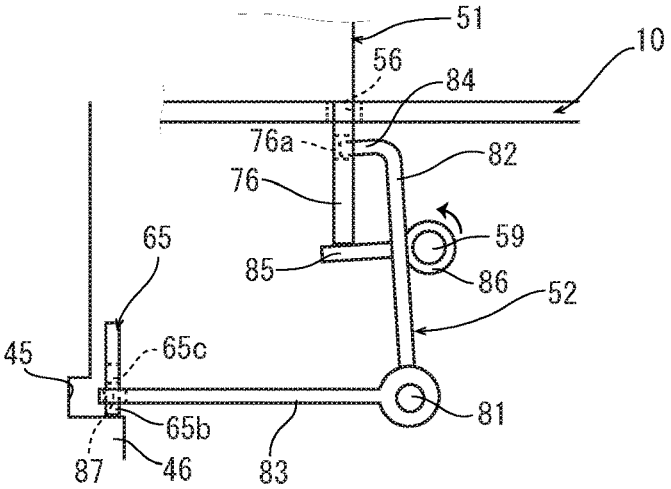
Figure 14C:
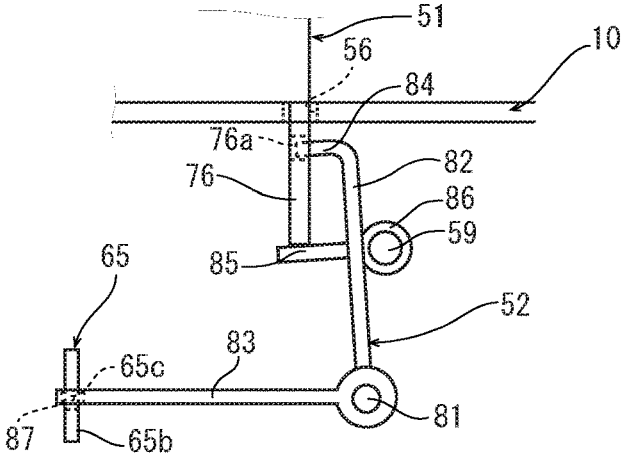
Figure 15:
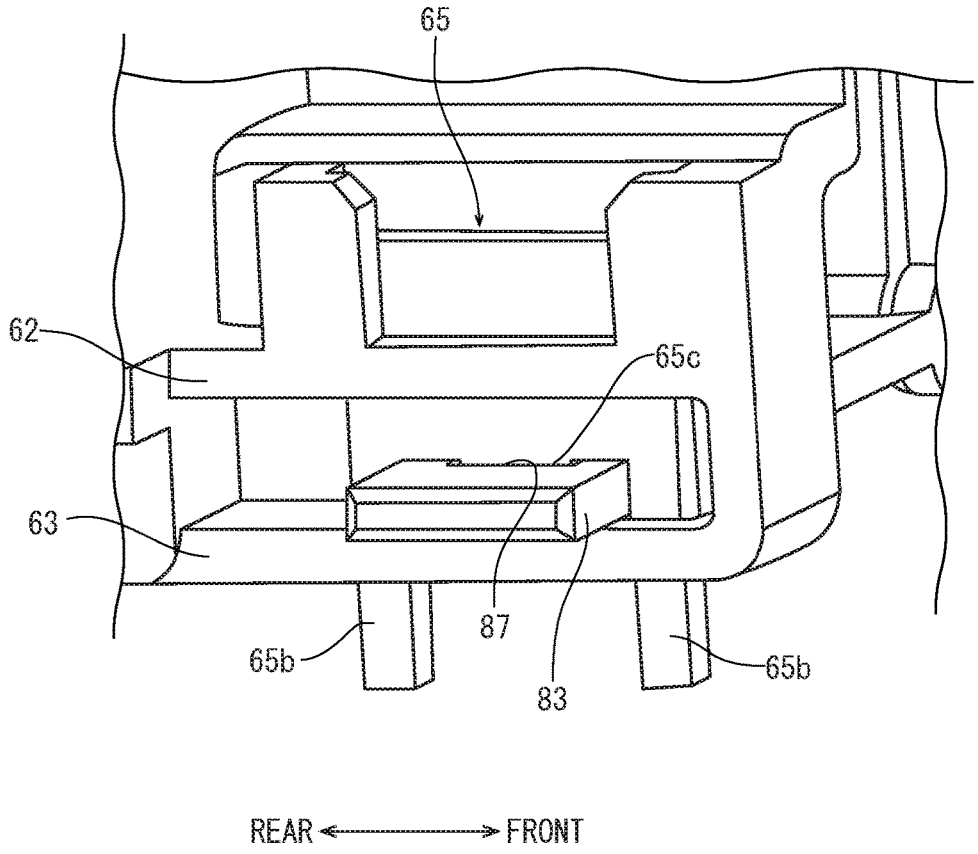
FIG. 15 is a perspective view showing the locking piece and the locking member engaged with each other in the color printer according to the embodiment of the present disclosure.
Figure 16:
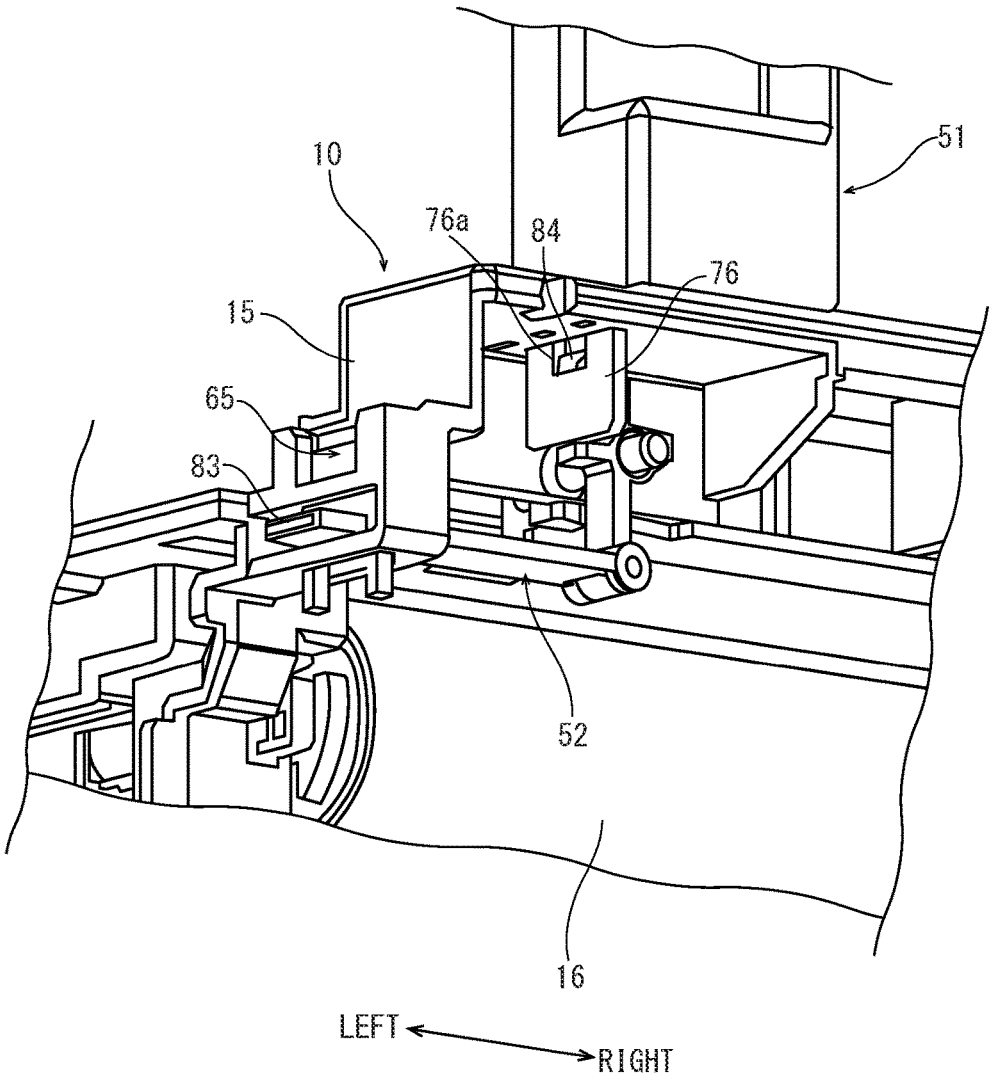
FIG. 16 is a perspective view showing the intermediate transferring unit detached from the unit storing part, wherein the once-detached cover member is re-attached, in the color printer according to the embodiment of the present disclosure.

In the color printer 1 having the above-described configuration, attaching/detaching of the cover member 51 of the intermediate transferring unit 10 will be described with reference to FIGS. 5-10 and FIGS. 11-15. FIG. 11 is a perspective view illustrating an attaching time of the cover member 51, FIG. 12 is a perspective view illustrating the pressing member 35 at the attaching time of the cover member 51, and FIG. 13 is a perspective view illustrating a state re-attaching the once-detached cover member 51. FIGS. 14A, 14B and 14C are schematic views used for describing operation of the locking member 52, FIG. 15 is a perspective view illustrating locking operation of the locking piece 65, and FIG. 16 is a perspective view showing the intermediate transferring unit 10 detached from the unit storing part 5.

In a case attaching the cover member 51 to the intermediate transferring unit 10, the cover member 51 is supported in the state directed in the first direction (refer to FIG. 9A) where the three attachment pieces 75 are directed downwardly and the connecting piece 76 and the pressing piece 77 are directed to the left side and, as shown in FIG. 11, the three attachment pieces 75 are inserted into the three attaching holes 55 of the storing recess part 15*a* of the housing 15. Further, the connecting piece 76 and the pressing piece 77 are respectively inserted into the first opening 38 and the second opening 39 of the operation member storing part 31. Subsequently, a screw is passed through the through hole 73 formed in the attachment part 72 of the cover member 51 and fastened to the upper face of the storing recess part 15*a*. Thereby, the head part 33*a* of the drive lever 33 is inserted into the hollow part 71 from the fifth face 51*e* of the cover member 51, and then, is protected from external factor.

Further, as shown in FIG. 12, when the pressing piece 77 of the cover member 51 is inserted into the second opening 39, the distal end of the pressing piece 77 comes into contact with the guide face of the protrusion part 35*d* of the pressing member 35 stored in the operation member storing part 31. When the pressing piece 77 of the cover member 51 is further inserted into the second opening 39, the protrusion part 35*d* is pressed forwardly by the pressing piece 77 and the pressing member 35 is turned in the counter clockwise direction in FIG. 12 around the supporting shaft 40 and is shifted to the posture being possible to press the opening/closing switch 34.

If the pressing member 35 is thus shifted, when the top face cover 3 is turned to close the top face opening 2*a*, the actuator pin 21 is inserted into the operation member storing part 31 from the opening 36 to press the pressed part 35*a* of the pressing member 35 downwardly. Thereby, the pressing part 35*b* pushes the switch part 34*b* of the opening/closing switch 34 and the opening/closing switch 34 detects that the top face cover 3 is closed.

In a case where the cover member 51 is detached, fastening of the screw is released and he cover member 51 is detached from the housing 15. Thereby, the pressing member 35 is biased by the spring 43 and shifted to the posture being impossible to press the opening/closing switch 34.

Subsequently, the once-detached cover member 51 is supported in the state directed in the second direction (refer to FIG. 9B) where the three attachment pieces 75 are directed to the right side and the connecting piece 76 and the pressing piece 77 are directed downwardly and, as shown in FIG. 13, the connecting piece 76 is inserted into the first insertion opening 56 and the pressing piece 77 is inserted into the second insertion opening 57. As shown in FIG. 14A, when the connecting piece 76 is inserted into the first insertion opening 56, a distal end of the connecting piece 76 presses the pressed piece 85 of the locking member 52 downwardly. Thereupon, as shown in FIG. 14B, the short arm 82 is turned in the counter clockwise direction in FIG. 14B around the supporting shaft 59. Accordingly, the engaging piece 84 of the short arm 82 is engaged with the opening 76*a* of the connecting piece 76 of the cover member 51. Thereby, the cover member 51 is retained with respect to the intermediate transferring unit 10.

Moreover, the long arm 83 is moved to the right side while being turned around the rotation shaft 81. Thereby, the distal end of the long arm 83 is separated from the engaged recess part 45 of the unit storing part 5 and engaging of the intermediate transferring unit 10 and the unit storing part 5 is released. Further, since the long arm 83 is moved to the right side, the opening 87 reaches just below the protrusion piece 65*c* of the locking piece 65.

After engaging with the unit storing part 5 is thus released and the cover member 51 is retained with respect to the intermediate transferring unit 10, the intermediate transferring unit 10 becomes a state capable of being detached from the predetermined position of the unit storing part 5, and then, the intermediate transferring unit 10 is extracted from the unit storing part 5. Thereupon, the locking piece 65 run on the supporting piece 46 of the unit storing part 5 is fallen down in a vertical direction by its own weight. Accordingly, as shown in FIGS. 14C and 15, the protrusion piece 65*c* of the locking piece 65 is engaged with the opening 87 of the long arm 83, and then, movement of the long arm 83 is restricted. Thereby, turn of the locking member 52 is restricted and engaging of the locking member 52 and the cover member 51 is maintained.

As a result, as shown in FIG. 16, the intermediate transferring unit 10 is extracted from the unit storing part 5 in a state that the once-detached cover member 51 is re-attached.

As described above, in accordance with the color printer 1 of the present disclosure, in order to detach the intermediate transferring unit 10, after the cover member 51 is detached, it is necessary to re-attach the once-detached cover member 51 to the intermediate transferring unit 10. Therefore, it is possible to prevent the once-detached cover member 51 from being lost. Further, by attaching the cover member 51 after the intermediate transferring unit 10 is attached to the unit storing part 5, the pressing member 35 is shifted to the posture being possible to press the opening/closing switch 34. That is, after the intermediate transferring unit 10 is attached to the unit storing part 5, unless the cover member 51 is attached, because it is impossible to press the opening/closing switch 34 and to detect that the top face opening 2*a* is closed by the top face cover 3, it is impossible to activate the color printer 1. Therefore, it is possible to prevent attaching of the cover member 51 from being forgotten. Incidentally, the opening/closing switch 34 may be a switch detecting an opening/closing condition of another opening/closing member other than the top face cover 3.

Moreover, when the once-detached cover member 51 is re-attached to the intermediate transferring unit 10, since the cover member 51 and the locking member 52 are engaged with each other by the concave-convex parts (the first concave-convex parts), it is possible to prevent the cover member 51 from being released from the intermediate transferring unit 10. Further, when the intermediate transferring unit 10 is detached from the unit storing part 5, the concave-convex parts (the second concave-convex parts) of the locking piece 65 and the locking member 52 are engaged with each other to restrict turn of the locking member 52, it is possible to maintain engaging of the cover member 51 and the locking member 52 and to prevent the cover member 51 from being released from the intermediate transferring unit 10. Thus, it is possible to surely prevent loss and forgetting of attachment of the cover member 51.

Further, the three attachment pieces 75 provided in the cover member 51 and the attaching holes 55 into which the attachment pieces 75 are respectively inserted may be configured to have an incompatible form in a different shape according to specification of the intermediate transferring unit 10. Therefore, it is possible to prevent the intermediate transferring unit 10 in different specification, such as different destination, from being attached.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. An image forming apparatus comprising:

an imaging unit being attachable/detachable at a predetermined position of an apparatus body and carrying out image forming;

wherein the imaging unit includes:

a locking member configured so as to move between a lock position where it is engaged with the apparatus body when the imaging unit is attached to the predetermined position and a lock release position where engaging with the apparatus body is released; and a cover member being attachable to/detachable from the imaging unit so as to be attached to the imaging unit in a first direction in a case where the imaging unit is attached to the apparatus body and to be attached to the imaging unit in a second direction different from the first direction in a case where the imaging unit is detached to the apparatus body, the cover member has a connecting part attached to the imaging unit in the state directed in a second direction, when the cover member is attached to the imaging unit in the second direction, the connecting part moves the locking member from the lock position to the lock release position and the imaging unit becomes a state capable of being detached from the predetermined position.

2. The image forming apparatus according to claim 1, wherein in the cover member and the locking member, respective first concave-convex parts engaged with each other when the cover member is attached to the imaging unit in the second direction are formed.

3. The image forming apparatus according to claim 1, wherein the imaging unit includes a locking piece provided so as to move according to movement of the imaging unit from the predetermined position, in the locking piece and the locking member, respective second concave-convex parts engaged with each other when the imaging unit is moved from the predetermined position after the cover member is attached to the imaging unit in the second direction are formed.

4. The image forming apparatus according to claim 1 further comprising:

a switch member detecting a closing condition and an opening condition of the opening/closing member opening and closing an opening formed in the apparatus body by pressing and releasing this pressing; and a pressing member arranged so as to be shifted between a posture being possible to press the switch member and a posture being impossible to press the switch member, wherein the cover member shifts the pressing member to the posture being possible to press the switch member by being attached to the apparatus body in the first direction.

5. The image forming apparatus according to claim 1, wherein in the imaging unit and the cover member, an attaching hole and an attachment piece engaged with each other when the cover member is attached to the imaging unit in the first direction are respectively formed and the attaching hole and the attachment piece have incompatible forms configured in different shapes according to specification of the imaging unit.

6. The image forming apparatus according to claim 1 further comprising:

an image forming unit; and a drive lever connecting a connection part of the image forming unit and a connection part of a drive source provided in the apparatus body and releasing this connecting, wherein the cover member has a hollow part possible to store the drive lever and stores the drive lever in the hollow part when the cover member is attached to the apparatus body in the first direction.

* * * * *